United States Patent [19]

Wright

[11] Patent Number: 4,540,105

[45] Date of Patent: Sep. 10, 1985

[54] CLOSURE OPENING HAVING PROTECTIVE BEAD

[75] Inventor: Philip M. Wright, City of Industry, Calif.

[73] Assignee: General Can Company, Inc., City of Industry, Calif.

[21] Appl. No.: 640,134

[22] Filed: Aug. 13, 1984

[51] Int. Cl.[3] ..... B65D 41/09

[52] U.S. Cl. ..... 220/359; 220/260

[58] Field of Search ..... 220/307, 260, 359, 254; 229/43, 5.6

[56] References Cited

U.S. PATENT DOCUMENTS

| | | | |
|---|---|---|---|
| 3,547,305 | 12/1970 | Khoury | 220/359 |
| 3,990,603 | 11/1976 | Brochman | 220/260 |
| 4,171,063 | 10/1979 | Choutier | 220/307 |

*Primary Examiner*—George T. Hall

*Attorney, Agent, or Firm*—Barnes, Kisselle, Raisch, Choate, Whittemore & Hulbert

[57] ABSTRACT

A metallic closure for a cylindrical, rectangular or square container comprising a central panel. A part of the panel is adapted for attaching the closure to the end of a container to close the end. The panel has an opening therein and the portion of the metal adjacent the opening is rolled so that the end thereof engages under the inner surface of the panel in a smooth roll such that the free edge is not directly exposed to the contents in the container on which the closure is placed. A composite panel is bonded to the central panel on the outer surface of the central panel. The closure is 100% safe. When the composite panel is removed a residue remains on the outer surface of the metal panel providing evidence of tampering.

7 Claims, 3 Drawing Figures

CLOSURE OPENING HAVING PROTECTIVE BEAD

This invention relates to metallic closures for cylindrical, rectangular or square containers.

BACKGROUND AND SUMMARY OF THE INVENTION

A common type of metallic convenience closure comprises a panel with an endless score line forming a central removable portion and a peripheral fixed portion that is attached to the cylindrical container. A pull-tab having a nose portion is fastened to the removable portion by a rivet so that when the pull-tab is manually grasped, the nose portion of the pull-tab moves into position adjacent the score line severing the panel. Further movement of the pull-tab completes the severing to remove the removable portion. Typical patents showing such construction are U.S. Pat. Nos. 3,696,961, 3,705,563, 3,819,083 and 3,986,632.

Such closures are effective for the intended purpose but do require various manipulations in the manufacture that increase the cost.

However, they are not 100% safe. If the user of the product in the can moves his hand or finger with a circular motion when in contact with the panel remaining on the can, a cut will occur.

It has also been suggested that a closure be previded which has an opening that is closed by a panel which can be removed or broken as shown, for example, in U.S. Pat. Nos. 3,245,576, 3,274,962, 3,380,622, 3,547,305, 4,253,584 and 3,628,689. A major difficulty with respect to such closures is that the free edge of the metal closure is exposed to the contents and depending upon the contents is a point of incipient corrosion and contamination of the contents.

Accordingly, among the objectives of the present invention are to provide a metal closure which has a panel that can be removed wherein the closure is constructed and arranged to minimize to any tendency for corrosion and resultant contamination of the contents and which is 100% safe.

In accordance with the invention, the metallic closure for a cylindrical container comprises a central panel including means forming a part of the panel for attaching the closure to the end of a container to close the end. The panel has an opening therein and the portion of the metal adjacent the opening is rolled so that the end thereof engages under the inner surface of the panel in a smooth roll such that the free edge is not directly exposed to the contents in the container on which the closure is placed. A composite panel is bonded to the central panel on the outer surface of the central panel.

DESCRIPTION

Figure 1:
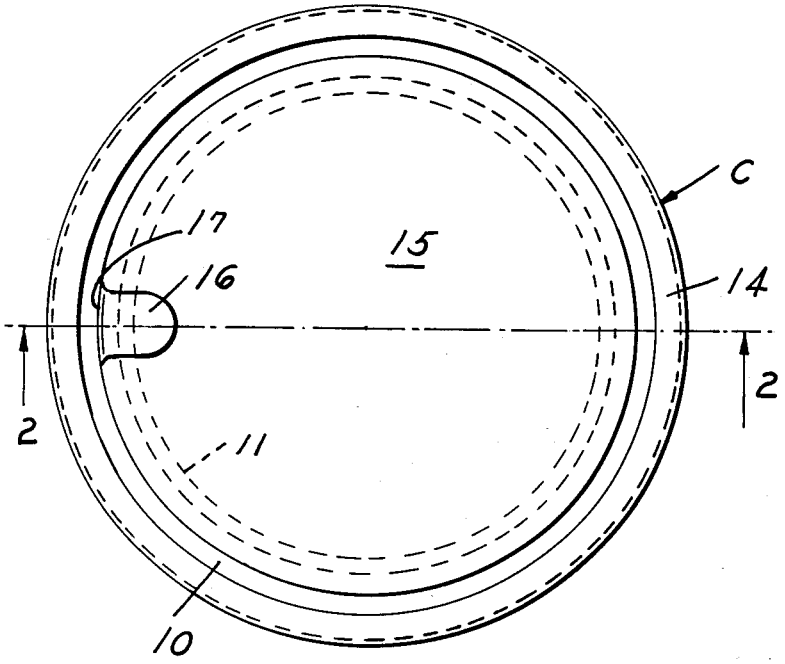
FIG. 1 is a plan view of the closure embodying the invention.
Figure 2:
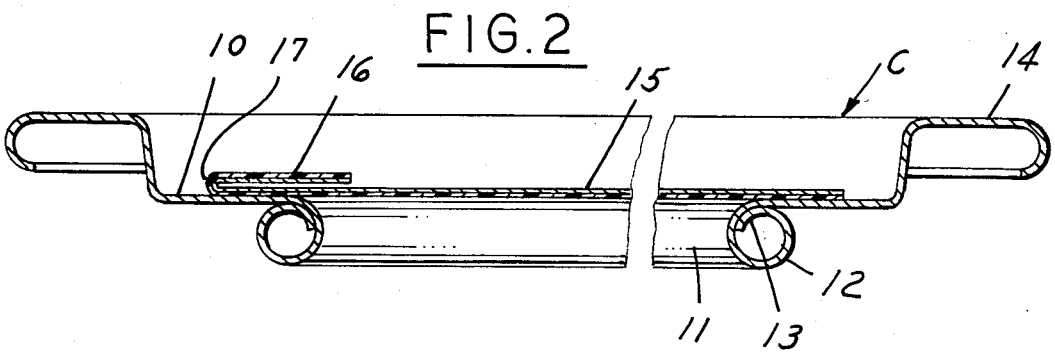
FIG. 2 is a sectional view taken along the line 2—2 in FIG. 1.
Figure 3:
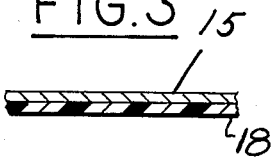
FIG. 3 is a fragmentary sectional view on an enlarged scale of a portion of the composite panel forming part of the closure.

Referring to the drawings, the closure C embodying the invention comprises a metallic panel or body 10 which includes a central circular opening 11 formed by cutting away a portion of the panel and rolling the edge 12 of the opening axially and radially so that it faces inwardly with respect to the container when the closure is on the container. More specifically, the periphery of the opening in the panel is formed into a circular bead 12 and the free end 13 engages the inner surface of the metal panel 10 substantially tangentially along the bead 12, so that the edge of the end is not directly exposed to the contents of the container. The closure includes an annular channel 14 whereby the closure C can be double seamed to the top of a cylindrical container in accordance with well known practice.

A flexible composite panel 15 is bonded to the top or outer surface of the closure to close the closure. The panel 15 preferably includes a tab 16 that is normally folded along a crease line 17 onto the top surface of the foil panel 15, which tab 16 serves as a means for grasping and removing the panel and providing access to the contents.

The metal panel 10 can be made of tinplate blackplate or aluminum that is plain or coated having a thickness on the order of 0.005"-0.010".

The composite panel 15 comprises a flexible base of metal foil or paper, or both with a thin layer 18 of plastic covering the entire under surface adjacent the metal panel 10 and bonded to the outer surface of the metal panel, preferably by heat sealing through induction or convection. Other materials which can be used are aluminum or paper. Plastics which can be used are polypropylene or polyethylene or ethylene acetic alcohol (EAA).

In a preferred form, the composite panel comprises paper adhered to a metal foil having a layer of thermo plastic material bonded to the exposed surface of the foil. Thus, thhe paper is 30 pound kraft paper adhered by casein to an aluminum foil having a thickness of 0.000285 to 0.002 inch depending on the strength required in the ultimate use. A layer of plastic such as ethylene acetic alcohol (EAA) is bonded to the exposed surface of the foil and has a thickness on the order about 0.002 to 0.004 inch.

The closure embodying the invention is thus relatively inexpensive and obviates the problems that have heretofore been present in this type of closure.

A further feature of the resultant construction is that the opening or destruction of the foil membrane provided evidence of tampering. The various composite panels which comprise plastic and foil or plastic, foil and paper or plastic and paper leave a residue on the outer surface of the metal panel 10.

I claim:

1. A metallic closure for a container comprising a central panel, means forming a parting of the panel for attaching the closure to the end of a container to close the end, said panel having an opening therein, the portion of the metal adjacent the opening being rolled radially downwardly and outwardly and thereafter radially inwardly with the free edge extending radially inwardly and the portion adjacent the free edge engaging under the inner surface of the panel in a smooth roll such that the free edge is not directly exposed to the contents in the container on which the closure is placed or to the exterior, and a composite panel having a layer of plastic thermally bonded to the central panel on the outer surface of the central panel.

2. The closure set forth in claim 1 wherein said composite panel includes a radially extending tab for grasping the foil to remove it from the remainder of the closure.

3. The closure set forth in claim 2 wherein said tab is normally folded over the outer surface of said composite panel.

4. The closure set forth in claim 3 wherein said composite panel includes a crease line between said tab and the remainder of the panel.

5. The closure set forth in claim 1 wherein said composite panel comprises plastic, metal and foil.

6. The closure set forth in claim 1 wherein said composite panel comprises plastic and paper.

7. The closure set forth in claim 1 wherein said composite panel comprises plastic, metal foil and paper.

* * * * *